US008381944B2

(12) United States Patent
Strange et al.

(10) Patent No.: US 8,381,944 B2
(45) Date of Patent: Feb. 26, 2013

(54) CONTAINER WITH COMPLEMENTARY SAWTOOTH FEATURES ON LID AND BASKET TO FACILITATE OPENING

(75) Inventors: Randall Glenn Strange, Manteca, CA (US); Richard Louis Bontrager, Ripon, CA (US)

(73) Assignee: Penpack LLC, Exeter, CA (US)

( * ) Notice: Subject to any disclaimer, the term of this patent is extended or adjusted under 35 U.S.C. 154(b) by 162 days.

(21) Appl. No.: 12/943,730

(22) Filed: Nov. 10, 2010

(65) Prior Publication Data

US 2011/0139785 A1 Jun. 16, 2011

Related U.S. Application Data

(60) Provisional application No. 61/260,279, filed on Nov. 11, 2009.

(51) Int. Cl.
*B65D 41/18* (2006.01)
*B65D 43/16* (2006.01)
*B65D 51/16* (2006.01)

(52) U.S. Cl. ..... 220/793; 220/4.23; 220/839; 220/785; 220/786; 220/366.1

(58) Field of Classification Search ..... 220/4.22, 220/4.23, 23.83, 366.1, 785, 786, 788, 793, 220/839; 206/503
See application file for complete search history.

(56) References Cited

U.S. PATENT DOCUMENTS

| | | | | |
|---|---|---|---|---|
| 4,892,220 | A * | 1/1990 | Foos | 220/835 |
| 5,012,928 | A * | 5/1991 | Proffitt et al. | 206/508 |
| D467,496 | S | 12/2002 | Hayes et al. | |
| D478,282 | S | 8/2003 | Hayes et al. | |
| 6,644,494 | B2 | 11/2003 | Hayes et al. | |
| 6,845,878 | B2 | 1/2005 | Hayes et al. | |
| 7,441,672 | B2 * | 10/2008 | Cadiente et al. | 220/608 |
| 2008/0135556 | A1 * | 6/2008 | Bontrager et al. | 220/260 |

* cited by examiner

*Primary Examiner* — Anthony Stashick
*Assistant Examiner* — James N Smalley
(74) *Attorney, Agent, or Firm* — Loza & Loza, LLP; Heidi L. Eisenhut

(57) ABSTRACT

A container for holding goods comprises a basket having a base and a sidewall, a lid mateable with the basket, a first sawtooth structure formed within the sidewall and a second sawtooth structure formed within the lid and substantially mirroring the first sawtooth structure when the lid is mated with the basket.

20 Claims, 4 Drawing Sheets

CONTAINER WITH COMPLEMENTARY SAWTOOTH FEATURES ON LID AND BASKET TO FACILITATE OPENING

CLAIM OF PRIORITY

This application claims priority to U.S. Provisional Patent Application No. 61/260,279, entitled "CONTAINER WITH COMPLEMENTARY SAWTOOTH FEATURES ON LID AND BASKET TO FACILITATE OPENING," by Randall Glenn Strange, et al., filed on Nov. 11, 2009.

TECHNICAL FIELD

This invention relates generally to packaging, and more particularly to packaging for fragile and/or perishable goods.

BACKGROUND

Plastic berry baskets are ubiquitous in grocery stores and produce markets and can be found by consumers in a variety of shapes and sizes. For example, raspberries and blackberries and the like are sold in clear polyethylene terephthalate (PETE) clamshell containers holding anywhere from a half-pint to a quart or more of fruit. Baskets are commonly designed for consumer level use. It is therefore desirable for such baskets to be improved to benefit a consumer's experience accessing, storing, or otherwise using such baskets.

DETAILED DESCRIPTION OF THE DRAWINGS

Figure 1:
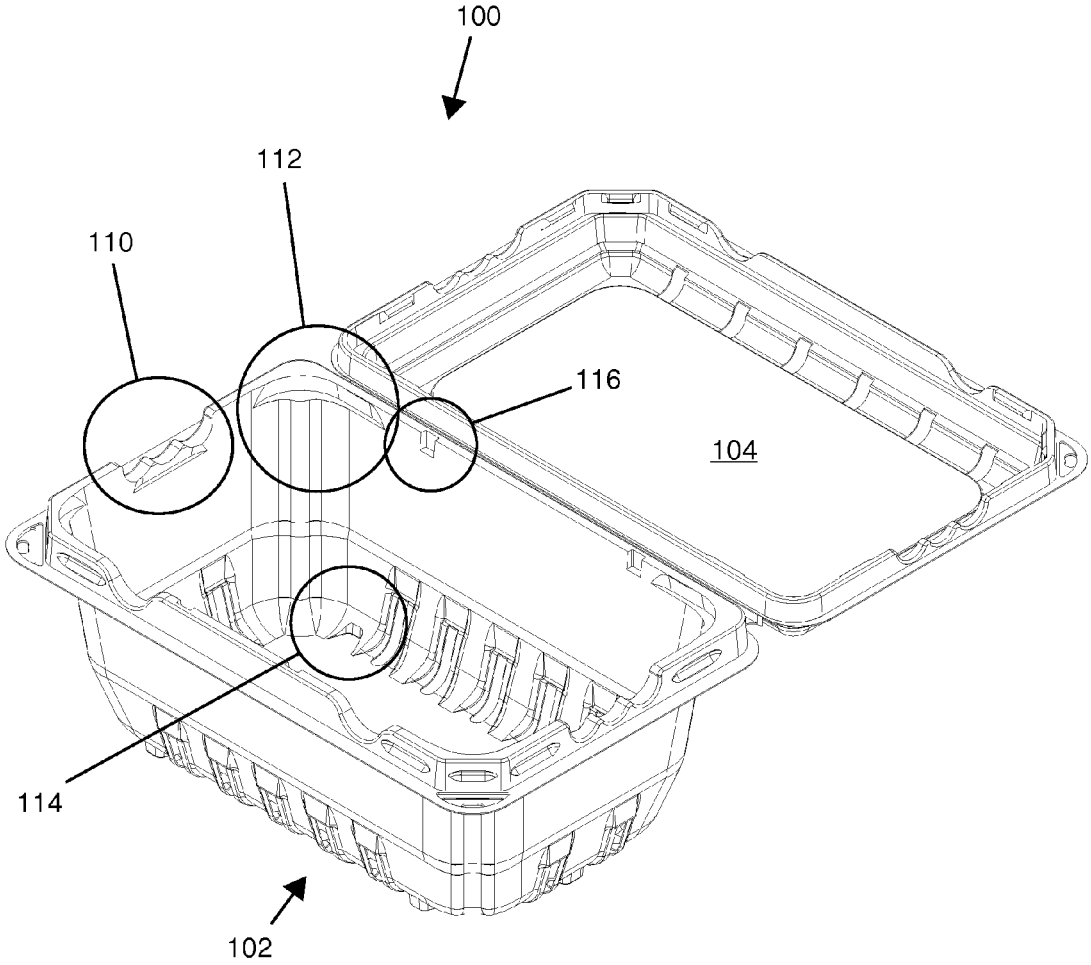
FIG. 1 is a perspective view of an embodiment of a container in accordance with the present invention.

Referring to FIGS. 1-3B, an embodiment of a container 100 in accordance with the present invention is shown. The container 100 comprises a basket 102 defined at least partially by a base 108 and a sidewall 106 extending from the base 108 to a flange 130. As shown, the base 108 has a generally rectangular footprint across the plane on which it rests. The sidewall 106 extending from the base 108 consequently has four faces. Alternatively, in other embodiments the footprint of the base 108 can be some other shape, such as square or triangular for example.

The base 108 is generally flat, but in other embodiments the base can be slightly concave across the length of the container or alternatively can have some other shape relative to a plane on which the basket can rest, depending on a desired contact surface area, a desired flow of air and/or liquids along the base, etc. Optionally the base can be corrugated to include ridges that can serve one or more functions. For example, ridges can improve structural rigidity of the base; the ridges can provide channels for draining fluids and/or holding contents above fluids. Ridges can also function as registration features that are mateable with complementary features of a lid. Optionally the base can include one or more perforations, the one or more perforations permitting drainage, ventilation, ornamentation, or some other purpose. As shown, the body

204 includes perforations that begin at the base 108 and extend at least partially up along the sidewall 106.

Figure 3A:
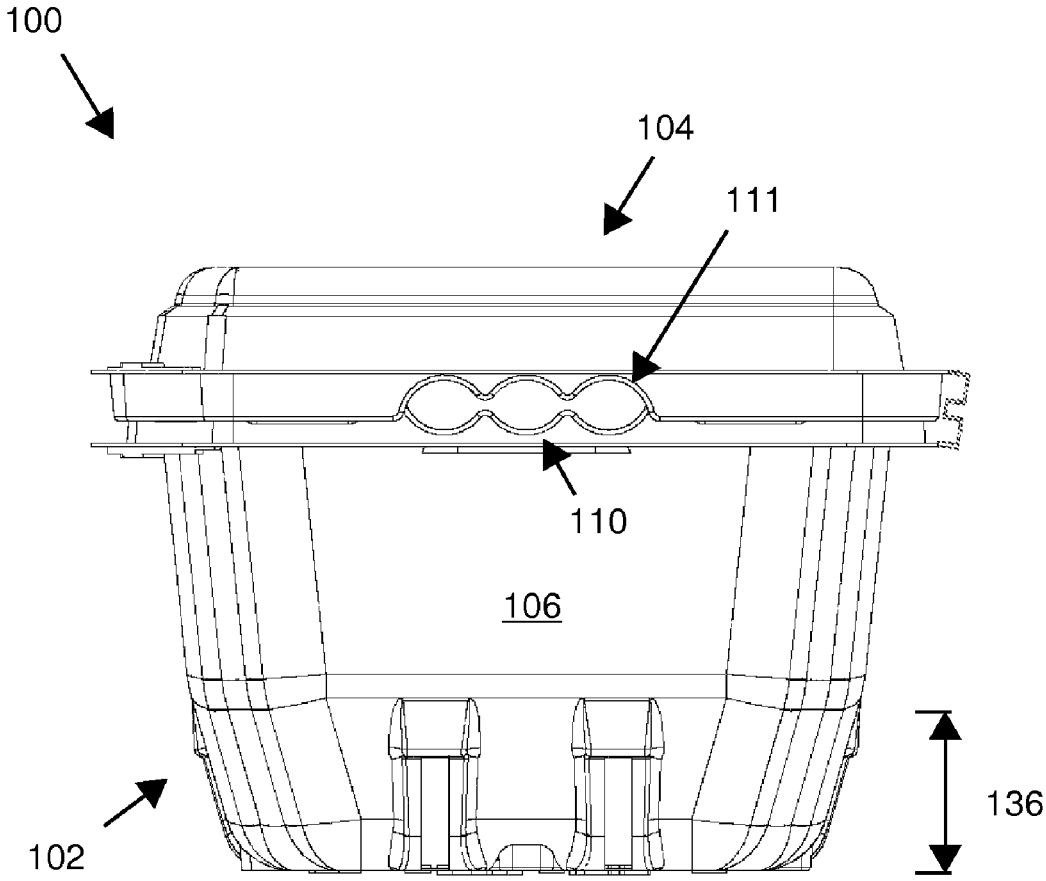
FIG. 3A is an end view of the container of FIG. 1 with lid closed.
Figure 3B:
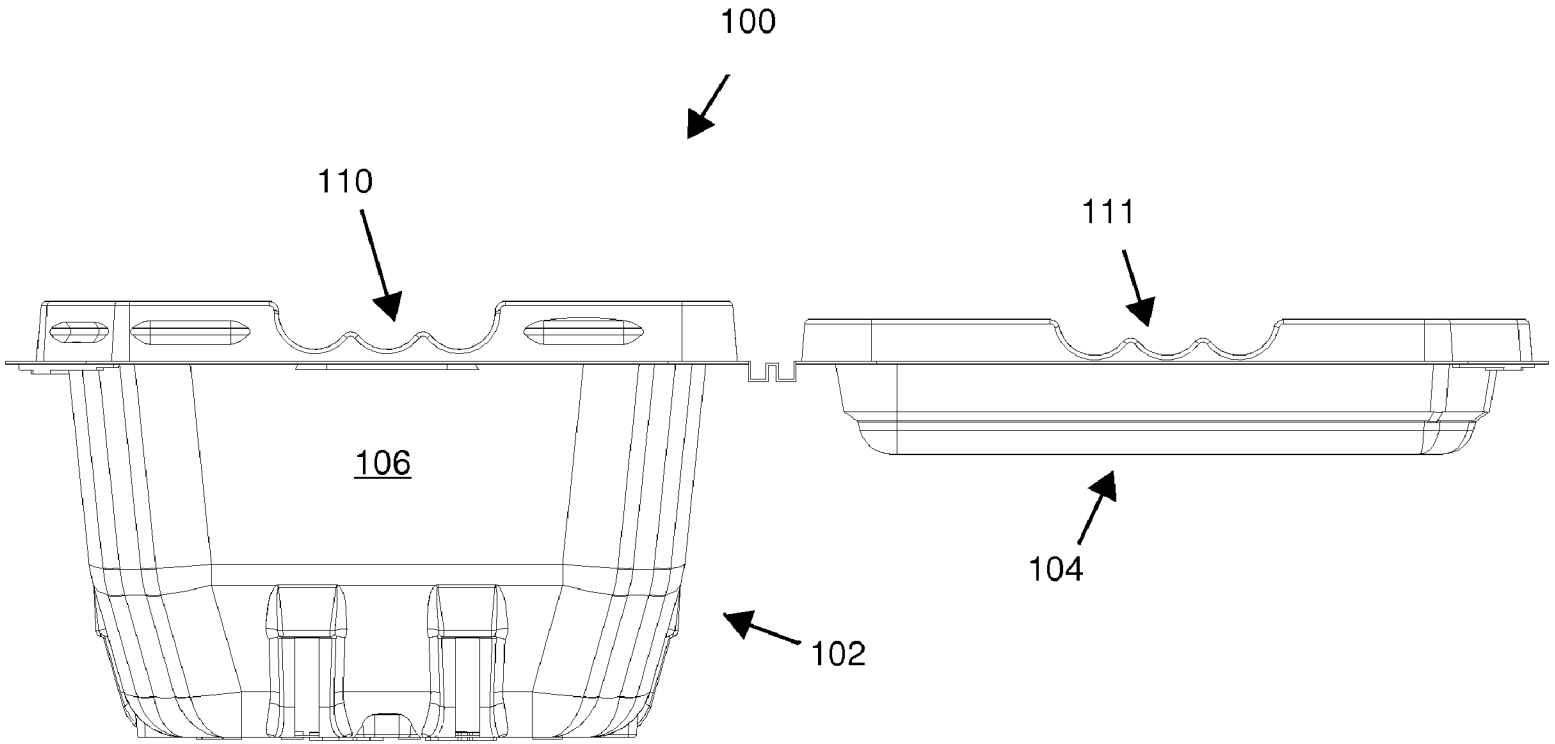
FIG. 3B is an end view of the container of FIG. 1 with lid open.

As shown in FIGS. 3A and 3B, the sidewall 106 includes a compound draft from the flange 134 to the base 108. The draft is compound because a portion 136 of the draft connected with the base 108 increases in angle. One or both angles of the compound draft can be varied to suit manufacturing or to selectively adjust a volume of the basket. A sharper draft decreases basket volume, but can aid in manufacturing by easing ejection of the body from a mold. In other embodiments, the sidewall 106 can include a simple draft from the flange to the base. In still other embodiments, the sidewall 106 need not include a draft from the flange to the base, or can include a compound draft including more than two angles. In still further embodiments, one face of the sidewall 106 can include no draft, or a draft having a different angle when compared with that of another face of the sidewall 106. One of ordinary skill in the art will appreciate the myriad different shapes including or excluding drafts with which the sidewall 106 extending from the base 108 to the flange 134 can be formed. Embodiments of baskets in accordance with the present invention are intended to be applied to all such shapes without necessary differentiation.

As shown, the faces of the sidewall 106 of the basket 102 meet at corners 140 one or more of which has an arcuate shape extending substantially along the length of the corner 140 from the base 108 to the flange 134 of the basket. Such features are described in more detail in U.S. patent Ser. No. 11/754,166, entitled "BASKET HAVING IMPROVED SIDEWALL STRUCTURE" by Bontrager et al., incorporated herein by reference. The arcuate shape of the one or more corners can provide structural strength to faces of the sidewalls 106 connected with the one or more corners 140, resisting and or limiting sidewall 106 collapses that can result in damage to goods held within the basket 102. The arcuate shape of the one or more corners 140 can optionally reduce or eliminate a need for ribs or other reinforcing structures integrally formed with one or more of the faces of the sidewall 106, thereby reducing the resulting surface area of the sidewall 106. A reduction of the amount of surface area of the sidewall 106 can reduce the amount of material used to form the basket 102.

The arcuate shape connects one face of the sidewall 106 to an adjacent face of the sidewall 106, supplanting a corner formed by at an intersection of the faces of the sidewall 106. The arcuate shape of the corner 140 can provide rigidity by providing a structural shape that distributes stress across the arc of the structure. Such a shape eliminates a concentration of stress at a corner, thereby improving a response to force applied to the sidewall 106. The arcuate shape of the corner 140 can reduce a cross-sectional area of the basket 102 but can result in a reduction in sidewall thickness and/or surface area of one or more faces of the sidewall 106 to reduce an amount of material used to form the basket 102. A length and width of the sidewall 106, or alternatively the draft of the sidewall 106 can be increased to accommodate a lost volume attributable to the arcuate shape of the one or more corners 140. The arcuate shape of FIG. 1B further includes no sharp edges, reducing a risk of damage to delicate goods stored in the container 100.

Figure 2:
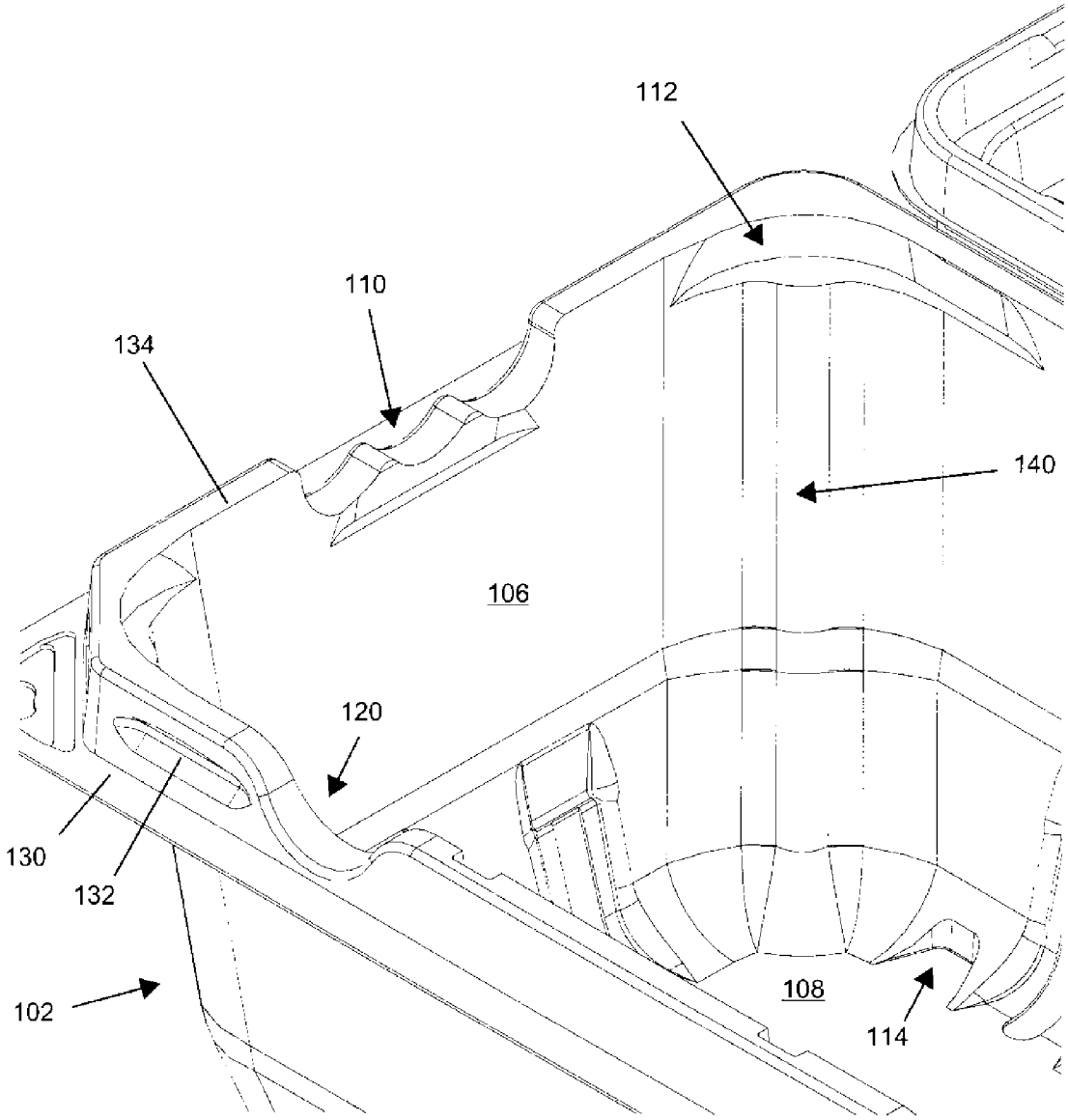
FIG. 2 is a close-up view of a portion of the container of FIG. 1.

Referring to FIG. 2, the container 100 further includes a pair of finger holes 120 arranged along a portion of the flange 134 opposite a hinge with which the lid 104 is connected to the basket 102. The finger holes 120 allow a finger to be positioned between the lid 104 and the flange 134, easing separation of the lid from the basket 102. As shown, the flange 134 includes two finger holes 120 arranged symmetrically along a portion of the flange 134 that is opposite of a hinge.

The finger holes 120 form a smooth indention within the flange 134, allowing easy insertion of a finger of a consumer. By including the finger holes 120, the lid 104 can be secured to the flange 134 such that a required force to separate the lid from the flange 134 is optionally increased over a basket excluding finger holes. Separation can be accomplished by pushing a finger with increasing diameter into a finger hole 120 or inserting a finger and pulling the lid away from the basket 102 while restricting movement of the basket 102, rather than grasping both the lip 130 of the flange 134 (or basket 102) and the lid 104 and applying a pulling force. Providing one or more finger holes 120 reduces the frictional properties of the material as a measure of the ease of opening the basket.

The flange 134 further includes a pair of indentations 132 on each of the three faces of the sidewall 106 adjacent or opposite the hinge connecting the lid 104 to the basket 102. Protuberances (not shown) extend from inside the lid 104 that complement, and are received in the indentations 132 to resist separation of the lid 104 from the basket 102 when the container 100 is closed. In other embodiments, the flange and lid can include more or fewer complementary structures, and the complementary structures can be swapped so that protuberances extend from the flange and the indentations are present in the lid.

Embodiments of containers 100 in accordance with the present invention further comprise a flange 134 having a sawtooth feature (also referred to herein as a sawtooth structure) 110 along faces of the sidewall 106 adjacent to, and extending from the hinge connecting the lid 104 and basket 102. The sawtooth feature 110 generally resembles three abutting fingers. A sawtooth feature 111 of the lid 104 mirrors the sawtooth feature 110 of the flange 134 so that when the lid 104 is closed and mated with the basket 102 (see FIG. 3A) an opening have a shape resembling a string of beads is formed. The sawtooth features 110, 111 when mated provide a space roughly sized and shaped to receive three fingers of a consumer. As the consumer's fingers are further urged into the container 100, the increasing diameter of the fingers push the complementary sawtooth features 110, 111 apart to open the container 100 and separate the lid 104 from the basket 102. The complementary sawtooth features can alternatively be shaped to accommodate two fingers or four fingers, and alternatively can be included in the flange along the face of the sidewall opposite the hinge, supplanting finger holes 120, for example.

The sidewalls 106 further include a first set of de-nesting features 112, each feature formed at an arcuate corner. As shown, the de-nesting feature 112 is a ledge interrupting the sidewall along the arcuate corner as the sidewall approaches the flange 134. The de-nesting features 112 allow multiple containers 100 nested within each other (i.e., with baskets received within baskets) to be separated with relative ease. As shown, when multiple containers 100 are nested within each other, the ledges rest on each other. A second set of de-nesting features 116 is shown with pairs of de-nesting features 116 along opposite faces of the sidewall 106. As shown, the de-nesting features 116 of the second set resemble notches. De-nesting features can assist in automated as well as manual handling. As shown, the container 100 further includes registration features (also referred to herein as stacking features) 114 for assisting stacking.

In a preferred embodiment, the container can be formed from PETE. However, in other embodiments the container can be formed from any resin known in the art for manufacturing plastic containers. For example, the container can be formed from any of high density polyethylene (HDPE), polyvinyl chloride (PVC), low density polyethylene (LDPE), polypropylene (PP), polystyrene (PS), and polycarbonate. Alternatively, the container can be formed from a material other than plastic resin, for example the container can be formed from paperboard or a composite material such as fiber-reinforced polymer (FRP) or glass-reinforced plastic (GRP).

The foregoing description of the present invention has been presented for purposes of illustration and description. It is not intended to be exhaustive or to limit the invention to the precise forms disclosed. Many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

The invention claimed is:

1. A container for holding goods comprising:

a basket having a base and a sidewall extending from the base to a flange, the sidewall having four faces, the four faces including a pair of end walls, a front wall and a back wall;

a lid mateable with the basket;

a first sawtooth structure formed within a first end wall of the pair of end walls, the first sawtooth structure comprising a first set of at least three concave grooves integrally connected by ridges;

a second sawtooth structure formed within the lid and substantially minoring the first sawtooth structure when the lid is mated with the basket;

a third sawtooth structure formed within a second end wall of the pair of end walls, the third sawtooth structure comprising a second set of at least three concave grooves integrally connected by ridges; and a fourth sawtooth structure formed within the lid and substantially mirroring the third sawtooth structure when the lid is mated with the basket;

wherein the first sawtooth structure and the second sawtooth structure form a first opening that generally resembles a first string of beads;

wherein the third sawtooth structure and the fourth sawtooth structure form a second opening that generally resembles a second string of beads.

2. The container of claim 1, further comprising a set of de-nesting features, wherein each of the de-nesting features is formed along a face of the sidewall.

3. The container of claim 2, wherein the set of de-nesting features includes two pairs of notches formed along opposite faces of the sidewall.

4. The container of claim 1, wherein the at least three concave grooves is comprised of a pair of outer grooves integrally connected to an inner groove by the ridges and wherein each outer groove of the pair outer grooves includes an outer side portion extending upwardly to a top portion of the flange and an inner side portion extending upwardly to the ridges.

5. The container of claim 4, wherein the ridges are located below the top portion of the flange.

6. The container of claim 4, wherein the first outer groove is a mirror image of the second outer groove and wherein each side of the inner groove is the same.

7. The container of claim 1, wherein the ridges of the first sawtooth structure are separated from the ridges of the second sawtooth structure when the lid is mated with the basket.

8. The container of claim 1, further comprising:

a first finger-hole having a first upper groove in an upper flange of the lid and a first lower groove in the flange of the basket; and a second finger-hole having a second upper groove in the an upper flange of the lid and a second lower groove in the flange of the basket;

wherein the first and second finger-holes are formed when the lid is mated with the basket;

wherein the first the first and second finger-holes are separated by a front portion of the flange.

9. The container of claim 8, further comprising:

a first indentation located between the first lower groove and the first end wall in the flange of the basket;

a second indentation located between the second lower groove and the second end wall in the flange of the basket;

a first protuberance located adjacent the first upper groove on the lid and in alignment with the first indentation; and a second protuberance located adjacent the second upper groove on the lid and in alignment with the second indentation;

wherein the first indentation and first protuberance are mated when the lid is mated with the basket;

wherein the second indentation and second protuberance are mated when the lid is mated with the basket.

10. A container for holding goods comprising:

a basket having a base and a sidewall extending from the base to a flange, the sidewall having four faces, the four faces including a pair of end walls, a front wall and a back wall;

a lid, having an upper flange, mateable with the basket;

a first sawtooth structure formed within a first end wall of the pair of end walls, the first sawtooth structure comprising a first set of at least three concave grooves integrally connected by a first set of ridges, the first set of at least three concave grooves comprising:

a first pair of outer grooves; and an inner groove integrally connected between the second pair of outer grooves by the second set of ridges;

wherein each outer groove of the first pair outer grooves includes a first outer side portion extending upwardly to a top portion of the flange and a first inner side portion extending upwardly to the first set ridges; and a second sawtooth structure formed within the lid and substantially minoring the first sawtooth structure when the lid is mated with the basket;

a third sawtooth structure formed within a second end wall of the pair of end walls, the third sawtooth structure comprising a second set of at least three concave grooves integrally connected by a second set of ridges, the second set of at least three concave grooves comprising:

a second pair of outer grooves; and a second inner groove integrally connected between the second pair of outer grooves by the second set of ridges;

wherein each outer groove of the second pair outer grooves includes a second outer side portion extending upwardly to a top portion of the upper flange and a second inner side portion extending upwardly to the second set of ridges; and a fourth sawtooth structure formed within the lid and substantially mirroring the third sawtooth structure when the lid is mated with the basket.

11. The container of claim 10, wherein the first sawtooth structure and the second sawtooth structure form a first opening that generally resembles a first string of beads; and wherein the third sawtooth structure and the fourth sawtooth structure form a second opening that generally resembles a second string of beads.

12. The container of claim 10, wherein the first set of ridges are located below the top portion of the flange; and wherein the second set of ridges are located below the top portion of the upper flange.

13. The container of claim 10, further comprising:

a first finger-hole having a first upper groove in the upper flange and a first lower groove in the flange; and a second finger-hole having a second upper groove in the upper flange and a second lower groove in the flange;

wherein the first and second finger-holes are formed when the lid is mated with the basket;

wherein the first and second finger-holes are separated by a front portion of the flange.

14. The container of claim 13, further comprising:

a first indentation located between the first lower groove and the first end wall;

a second indentation located between the second lower groove and the second end wall;

a first protuberance located adjacent the first upper groove on the lid and in alignment with the first indentation; and a second protuberance located adjacent the second upper groove on the lid and in alignment with the second indentation;

wherein the first indentation and first protuberance are mated when the lid is mated with the basket;

wherein the second indentation and second protuberance are mated when the lid is mated with the basket.

15. The container of claim 10, further comprising:

a first set of de-nesting features, wherein each of the de-nesting features in the first set of de-nesting features is formed along one of the end walls in the pair of end walls and the back wall, each of the de-nesting features in the first set of de-nesting features having an arcuate shape; and a second set of de-nesting features, wherein each of the de-nesting features from the second set is a notch formed along the back wall.

16. A container for holding goods comprising:

a basket having a base and a sidewall extending from the base to a flange, the sidewall having four faces, the four faces including a pair of end walls, a front wall and a back wall;

a lid, having an upper flange, mateable with the basket;

a first sawtooth structure formed within a first end wall of the pair of end walls, the first sawtooth structure comprising a first set of at least three concave grooves integrally connected by a first set of ridges, the first set of at least three concave grooves comprising:

a first pair of outer grooves; and a first inner groove integrally connected between the second pair of outer grooves by the second set of ridges;

wherein each outer groove of the first pair outer grooves includes a first outer side portion extending upwardly to a top portion of the flange and a first inner side portion extending upwardly to the first set ridges; and a second sawtooth structure formed within the lid and substantially mirroring the first sawtooth structure when the lid is mated with the basket;

a third sawtooth structure formed within a second end wall of the pair of end walls, the third sawtooth structure comprising a second set of at least three concave grooves integrally connected by a second set of ridges, the second set of at least three concave grooves comprising:

a second pair of outer grooves; and a second inner groove integrally connected between the second pair of outer grooves by the second set of ridges;

wherein each outer groove of the second pair outer grooves includes a second outer side portion extending upwardly to a top portion of the upper flange and a second inner side portion extending upwardly to the second set of ridges; and a fourth sawtooth structure formed within the lid and substantially mirroring the third sawtooth structure when the lid is mated with the basket;

a first finger-hole having a first upper groove and a first lower groove; and a second finger-hole having a second upper groove and a second lower groove;

wherein the first and second finger-holes are formed when the lid is mated with the basket;

wherein the first and second finger-holes are separated by a front portion of the flange.

17. The container of claim 16, wherein the first sawtooth structure and the second sawtooth structure form a first opening that generally resembles a first string of beads; and wherein the third sawtooth structure and the fourth sawtooth structure form a second opening that generally resembles a second string of beads.

18. The container of claim 16, wherein the first set of ridges are located below the top portion of the flange.

19. The container of claim 16, wherein a first outer groove in the first pair outer grooves is a mirror image of a second outer groove in the first pair of outer grooves and wherein each side of the first inner groove is the same.

20. The container of claim 16, wherein a first outer groove in the second pair outer grooves is a mirror image of a second outer groove in the second pair of outer grooves and wherein each side of the first inner groove is the same.

* * * * *